US008915205B2

(12) United States Patent
Miller et al.

(10) Patent No.: US 8,915,205 B2
(45) Date of Patent: Dec. 23, 2014

(54) FAIRLEAD LATCH DEVICE

(75) Inventors: Thomas Miller, Goleta, CA (US); Charlie O'Rourke, Ventura, CA (US)

(73) Assignee: Bardex Corporation, Goleta, CA (US)

( * ) Notice: Subject to any disclaimer, the term of this patent is extended or adjusted under 35 U.S.C. 154(b) by 0 days.

(21) Appl. No.: 13/335,832

(22) Filed: Dec. 22, 2011

(65) Prior Publication Data

US 2012/0160146 A1 Jun. 28, 2012

Related U.S. Application Data

(60) Provisional application No. 61/426,635, filed on Dec. 23, 2010.

(51) Int. Cl.
*B63B 21/18* (2006.01)
*B63B 21/10* (2006.01)

(52) U.S. Cl.
CPC ..... *B63B 21/10* (2013.01); *B63B 21/18* (2013.01)
USPC ..... 114/200

(58) Field of Classification Search
USPC ..... 114/200, 293
See application file for complete search history.

(56) References Cited

U.S. PATENT DOCUMENTS

| | | | | |
|---|---|---|---|---|
| 17,228 A | | 5/1857 | Osgood | |
| 1,458,354 A | | 6/1923 | Neller | |
| 2,362,531 A | | 11/1944 | Berger | |
| 2,608,174 A | | 8/1952 | Sponenburg | |
| 3,638,599 A | * | 2/1972 | Nilsen | 114/200 |
| 3,805,728 A | * | 4/1974 | Abraham | 114/200 |
| 3,842,776 A | | 10/1974 | Wudtke | |
| 3,912,228 A | | 10/1975 | Petty et al. | |
| 3,967,572 A | | 7/1976 | Lea | |
| 3,985,093 A | * | 10/1976 | Eidem | 114/293 |
| 4,020,779 A | | 5/1977 | Kitt | |
| 4,078,768 A | | 3/1978 | Krogstad et al. | |
| 4,423,697 A | * | 1/1984 | Royset | 114/199 |
| 4,430,023 A | | 2/1984 | Hayes et al. | |
| 4,476,801 A | | 10/1984 | Foster et al. | |

(Continued)

FOREIGN PATENT DOCUMENTS

| | | |
|---|---|---|
| DE | 2204818 | 8/1973 |
| GB | 1441971 | 7/1976 |
| WO | WO-2010/085156 | 7/2010 |

OTHER PUBLICATIONS

International Preliminary Report on Patentability mailed Jul. 4, 2013, during the prosecution of International Application PCT/US2011/067193.

(Continued)

*Primary Examiner* — Lars A Olson
*Assistant Examiner* — Jovon Hayes
(74) *Attorney, Agent, or Firm* — Fulbright & Jaworski LLP

(57) ABSTRACT

A self-aligning fairlead latch device is provided for guiding and securing an anchor chain between an offshore structure and an anchor. The fairlead latch device includes a latch housing pivotally mounted to a fairlead housing. The latch housing includes one or more latches for securing the anchor chain in place. The fairlead latch device further includes an upper retainer component that is coupled to an upper support structure and a lower support structure. The coupling of the upper retainer component to the support structures allow the fairlead latch device to be relocated by lifting of the device from the support structures.

28 Claims, 10 Drawing Sheets

(56) References Cited

U.S. PATENT DOCUMENTS

| | | | | | |
|---|---|---|---|---|---|
| 4,497,471 | A | | 2/1985 | Longberg et al. | |
| 4,513,681 | A | | 4/1985 | Crook | |
| 4,722,293 | A | | 2/1988 | Foster et al. | |
| 4,724,789 | A | | 2/1988 | van den Haak | |
| 4,742,993 | A | | 5/1988 | Montgomery et al. | |
| 4,862,821 | A | * | 9/1989 | Ballantyne | 114/293 |
| 4,941,776 | A | | 7/1990 | Bosgiraud et al. | |
| 4,958,805 | A | | 9/1990 | Willamsson | |
| 5,097,788 | A | | 3/1992 | Castel | |
| 5,146,775 | A | | 9/1992 | Ballard et al. | |
| 5,149,059 | A | | 9/1992 | Monahan | |
| 5,178,087 | A | | 1/1993 | O'Nion et al. | |
| 5,364,075 | A | * | 11/1994 | Montgomery | 254/415 |
| 5,390,618 | A | | 2/1995 | Wolff et al. | |
| 5,441,008 | A | | 8/1995 | Lange | |
| 5,476,059 | A | | 12/1995 | Pollack | |
| 5,730,425 | A | | 3/1998 | Brooks | |
| 5,845,893 | A | * | 12/1998 | Groves | 254/389 |
| 6,435,121 | B2 | * | 8/2002 | Siring | 114/200 |
| 6,817,595 | B1 | * | 11/2004 | Jenkins et al. | 254/389 |
| 7,059,262 | B2 | * | 6/2006 | Dove et al. | 114/210 |
| 7,104,214 | B2 | * | 9/2006 | Niebur | 114/230.2 |
| 7,240,633 | B2 | * | 7/2007 | Barlow | 114/200 |
| 7,392,757 | B2 | * | 7/2008 | Niebur | 114/200 |
| 7,926,436 | B2 | * | 4/2011 | Boatman et al. | 114/230.2 |
| 8,069,805 | B2 | * | 12/2011 | De Baan et al. | 114/230.26 |
| 2005/0072347 | A1 | * | 4/2005 | Niebur | 114/293 |

OTHER PUBLICATIONS

International Search Report and Written Opinion issued for PCT/US2011/067193, dated May 25, 2012, 9 pages.

World Oil: Exploration, Drilling, Production, as appeared in the Apr. and Jun. 1993 issues of World Oil, Reprinted from Apr. and Jun. 1993 World Oil. RTM.

* cited by examiner

FAIRLEAD LATCH DEVICE

CROSS-REFERENCE TO RELATED APPLICATIONS

This application claims priority to U.S. Provisional Application No. 61/426,635, filed on Dec. 23, 2010 and entitled FAIRLEAD LATCH DEVICE, the disclosure of which is incorporated in its entirety by reference.

TECHNICAL FIELD

The present disclosure relates to fairleads for mooring offshore structures. In particular, the present disclosure relates to underwater self-aligning fairlead latch devices for mooring production, drilling or construction platforms to the ocean floor.

BACKGROUND OF THE INVENTION

Offshore structures, such as floating production, drilling or construction platforms or spar buoys generally are moored in a desired location through the use of chains or cables secured between the platform and anchors on the ocean floor. Typically, the practice for mooring floating platforms includes extending a chain from the ocean anchor, through a fairlead device secured to the bottom of a platform column, to chain hauling equipment and latch mechanism, such as a chain stopper, on the deck of the platform.

Mooring platforms in place over a drilling location often require the implementation of many chains, fairlead devices, anchors and chain equipment because of the massive size of the platforms. For example, the deck area of a platform is typically large enough to hold one or more buildings for housing workers and machinery, a number of cranes, and a drilling tower or limited production facilities.

Also, floatation of platforms is typically provided by a pair of large submerged pontoons. In such structures, columns are utilized, some as large as 32 feet in diameter, to support the deck on the pontoons. As a consequence of the platform's massive structure, several fairlead devices are often secured to each column of the platform and mooring chains are run through each of the fairlead devices from the anchors to chain hauling equipment on the deck.

In a typical installation, the anchor lines are installed by passing a messenger wire rope from the deck, down through the submerged fairlead, mounted near the base of the support column, and out to a pre-installed anchor chain on the ocean floor. An end connector secures the messenger wire to the anchor chain and the anchor chain is hauled back to the platform. The anchor chain passes through the fairlead and continues up to the deck. One of the requirements of an underwater fairlead is that it be able to pass the chain itself, kenter shackles, special connecting links and the wire rope installation line. On the deck, the chain hauling equipment pretensions the chain up to a predetermined percentage of the chain breaking load and then the chain stopper or chain latch, located beneath the hauling device, locks the chain in place at the pre-tensioned load.

Once the floating platform is secured in place, anchor chains are almost continuously working due to the constant movement of the platform caused by winds, waves, tides, and currents. This constant movement of the anchor chains accelerates chain fatigue failure if the chain links engage a bending shoe or sheave that has a relatively small radius, for an extended period of time. As a result, fairlead devices are typically constructed as bending shoes or sheaves that have a relatively large radius. The sheaves used in these chain mooring applications are usually seven-pocketed wheels, also known as wildcats, which cradle the chain in pockets designed to reduce the chain stresses in the links on the wildcat.

One such device is described in U.S. Pat. No. 4,742,993 to Montgomery, et al., self-aligning quadrant fairlead is secured to a platform column. The arcuate fairlead is supported by a trunnion and bearing that enables the fairlead to swing about an upright axis for self-alignment. The current disclosure in its bending shoe configuration has some similarity to the Montgomery device except that the Montgomery device was designed for wire rope and did not include an underwater chain stopper.

Another device is described in U.S. Pat. No. 5,441,008 to Lange, where a submerged swiveling mooring line fairlead device is used on a structure at sea. The fairlead is rotatably mounted in a swiveling elongated rigid tube and a chain stopper is located at one end of the elongated rigid tube. The current disclosure differs from the Lange patent because the Lange device used a tubular body connected to a separate swivel mount and the Lange device does not permit the successful passing of the wire rope, chain, center shackles and special connectors as required by the anchor chain installation schemes which are currently in practice.

Neither the Lange nor Montgomery device can be used on the chain mooring systems currently in practice. The existing technology uses a huge, seven-pocketed wildcat underwater fairlead. During installation, a messenger wire rope is fed down from the equipment deck through the fairlead. The end of this messenger wire is connected to the pre-installed anchor chain with the aid of an anchor handling ship. The messenger wire is then hauled back in thereby pulling the wire, the special connectors and the chain through the fairlead and up to the equipment deck. At the equipment deck, the anchor chain is handed off to a massive chain hauling device which is then used to pull in additional chain catenary until the desired installation tension is reached in the chain. When this tension is reached, the chain stopper is engaged and the installation is complete.

A disadvantage of the existing fairleads is their massive size. In the current technology, the chain stopper is mounted up at the equipment deck. This means that the chain is always bearing on the underwater fairlead. These chain mooring systems are always designed for loading conditions up to the breaking strength of the chain and those links which are rounding the sheave in the underwater fairlead are subjected to high stresses in the links. The links on the sheave become the weak links of the system. In an attempt to offset this problem, the industry has recently gone from five-pocket wildcats to seven-pocket wildcats to increase the bending radius of the chain. The result has been massive size, weight and increased expense for a solution which only lessens the problem, but does not truly solve it.

Another disadvantage is that when the chain stopper was stored on the deck, greater deck and column loading resulted. This condition occurred because the chain was secured to the deck through the chain stopper, which pulled down on the deck and columns. The chain stopper equipment also occupied valuable deck space and added weight to the deck.

Another disadvantage is that the submerged fairlead device is not retrievable for repair. The only means to repair the fairlead is to remove the rig from the field and take it to dry dock.

Another device is disclosed in U.S. Pat. No. 5,845,893 to Groves, the disclosure of which is incorporated by reference, is an improvement over existing devices at the time of the invention. Nevertheless, it does not include the improvements disclosed herein, such as a way to facilitate relocation of a fairlead device.

BRIEF DESCRIPTION OF THE DRAWINGS

A better understanding of the present invention may be had by reference to the following drawings and contained numerals therein of which.

BRIEF SUMMARY OF THE INVENTION

Figure 1:
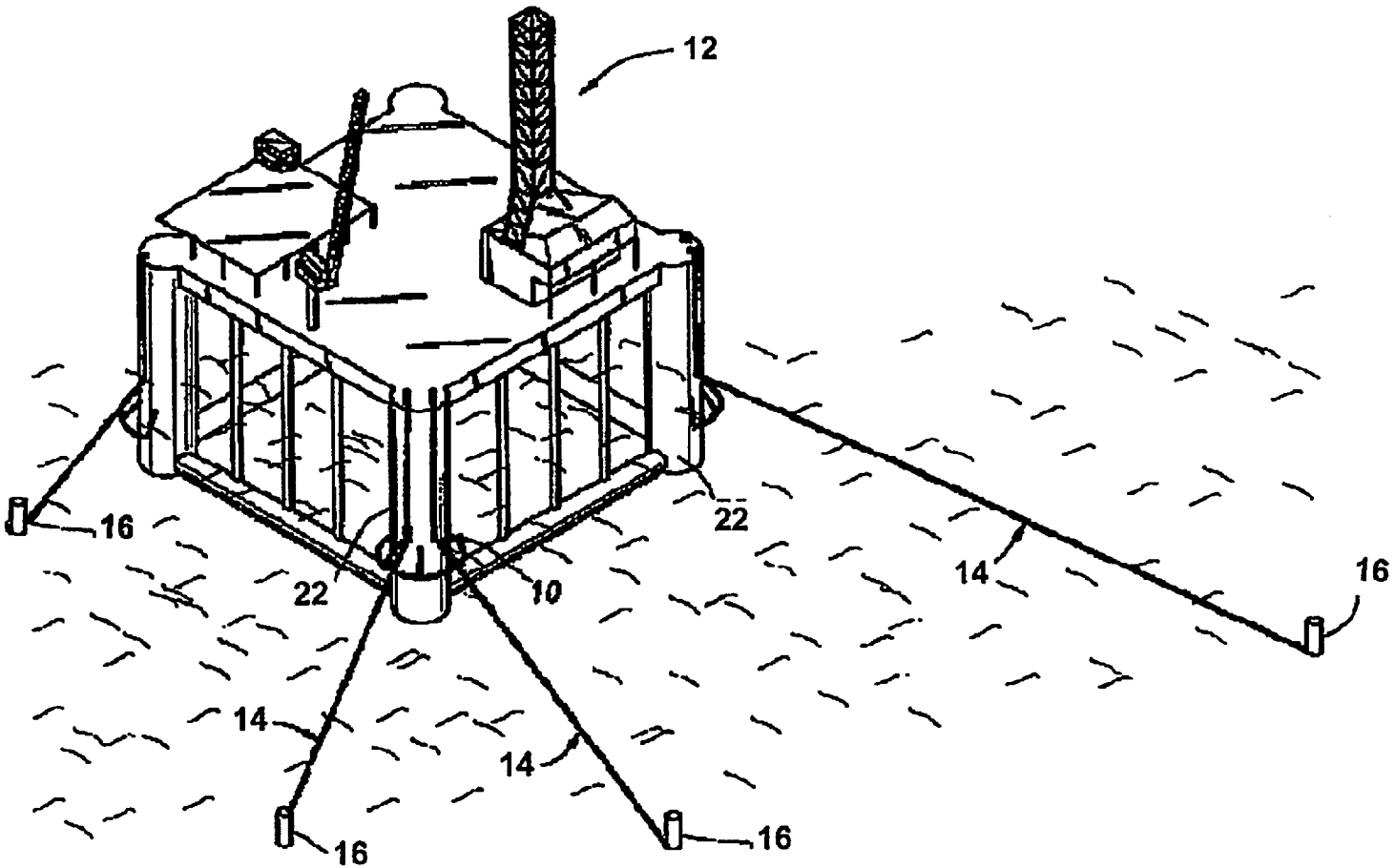
FIG. 1 is a perspective view of a typical offshore platform with at least one fairlead latch mechanism.

According to one aspect of the present disclosure, there is provided fairlead latch device for guiding and securing an anchor chain, the fairlead latch device comprising: a fairlead housing pivotally coupled to an offshore structure, wherein said fairlead housing comprises an upper retainer component coupled to an upper support structure attached to said offshore vessel, said upper retainer component configured to provide said pivotal coupling; wherein said fairlead housing is configured to receive and guide an anchor chain during deployment or retrieval of said anchor chain between said vessel and an anchor; a latch housing pivotally mounted to said fairlead housing, wherein said latch housing extends away from said fairlead housing; a latch mechanism mounted to said latch housing, wherein said latch device includes a ratchet assembly; and an actuator for operating said ratchet assembly.

In one embodiment, the fairlead housing is configured to guide an anchor chain using a guide structure selected from the group consisting of a chain wheel, a smooth wheel, and a bending shoe. In another embodiment, the ratchet assembly comprises at least two latches rotatably mounted to said latch housing. In another embodiment, the ratchet assembly comprises an hydraulic actuator for operating said latches. In yet another embodiment, the ratchet assembly comprises a manual system for operating said latches.

In one embodiment, the movement of said latches are linked. In another embodiment, the latch housing comprises an instrumentation system for measuring tension in the anchor chain. In another embodiment, the latch mechanism comprises a latch position indicator sensor. In yet another embodiment, the device further comprises a lower support structure coupled to said fairlead housing.

In one embodiment, the upper retainer component allows said fairlead latch device to be separated from said upper support structure. In another embodiment, the upper retainer component comprises at least one pin component, and said upper support structure comprises at least one attachment component corresponding to said at least one pin component, said at least one attachment configured to receive and retain said corresponding pin component. In yet another embodiment, the upper retainer component allows said fairlead latch device to be lifted from said upper support structure.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

DETAILED DESCRIPTION OF THE INVENTION

According to one aspect of the present disclosure, there is provided a self-aligning fairlead latch device for mooring an offshore structure such as production, drilling, or construction platforms or spar buoys or sea vessel. The fairlead latch device preferably comprises a fairlead housing configured to guide the anchor chain during the deployment or retrieval to facilitate the deployment or retrieval process. The fairlead housing preferably guides the anchor chain through a guide structure, such as a chain wheel, bending shoe, or smooth wheel. The fairlead latch device also preferably comprises a vertically pivoting latch mechanism, such as a chain stopper, mounted outboard of the horizontally swiveling fairlead housing. The fairlead latch device preferably further comprises an upper retainer structure that allows for the device to be mounted to an upper support structure attached to a wall of the offshore structure. In some embodiments, the fairlead latch device further comprises a lower support structure to provide additional support. The mounting configuration of the upper retainer component with the upper support structure allows for separation of the device from the attached upper support structure without requiring removal of a pivotal or other vertical pin that is part of the fairlead latch device. Instead, the upper retainer component allows the fairlead latch device to be lifted away from the attached upper support structure, straight from its mounted configuration. In the preferred embodiment, the upper retainer component comprises horizontal pin components that are go through corresponding vertical openings of the upper support structure when the fairlead latch device is mounted to the upper support structure. When the fairlead latch device needs to be moved or relocated, the horizontal pin components can be retracted from the vertical openings so that the fairlead latch device can be lifted away from the upper support structure.

According to one aspect of the present disclosure, the latch housing of the fairlead latch device is rotatably mounted to a fairlead housing and includes a latch mechanism, such as a chain stopper, for securing an anchor chain at a desired location between the underwater fairlead and the anchor. The fairlead housing is rotatably mounted to the offshore structure.

According to another aspect of the present disclosure, the fairlead latch device is used to moor an offshore structure. In one embodiment, when hauling equipment mounted on the deck pulls an anchor chain into and through the latch housing, the anchor chain is guided through the latch housing as it is pulled into the fairlead housing. A chain wheel mounted on the fairlead housing engages the links of the anchor chain and further directs the anchor chain from the latch housing to the deck. Once the anchor chain has reached the desired tension, the latches of the latch housing engage and secure the anchor chain in place. A very small amount of slack is then paid out by the deck hauling equipment so that the chain links on the chain wheel are completely unloaded. In one embodiment, the chain stopper can be hydraulically and/or mechanically controlled to open and allow chain payout.

The embodiments of the fairlead latch device of the present disclosure guide and secure an anchor chain between an anchor and an offshore structure such as a production, drilling, or construction platform or spar buoy, without the need for a large radius fairlead or deck mounted chain stoppers. Further, the embodiments of the fairlead latch device of the present disclosure are self-aligning and easily retrieved from their underwater installation.

The embodiments of the current disclosure minimizes inter-link chain wear and both in-plane and out-of-plane bending on the anchor chain. In one embodiment, the tension load measuring components are mounted on the latch housing arms such that they are not in the tension load path. The embodiment of the present disclosure allow the chain stopper to freely rotate about two perpendicular axes, therefore the motion change between the anchor chain (or mooring line) and offshore structures (including vessels) occurs on proper bearing surfaces and not between the fairlead and chain. In one embodiment, the maximum chain tension around the chain wheel is the mooring line pre-tension. This tension can be removed when the latch mechanism is engaged.

FIGS. 2-13 illustrate specific embodiments or particular features of the embodiments of the fairlead latch mechanism or device 10 according to the aspects of the present disclosure. Fairlead latch device 10 can be used on floating offshore structures such as the floating offshore production platform 12 shown in FIG. 1. Anchor chains or mooring lines 14 stabilize and moor platform 12 through connections to underwater anchors 16. Typically, a massive oil drilling or production platform or vessel requires several anchor chains or mooring lines 14 and anchors 16 to secure and stabilize it over the desired site. The tension in the anchor chains 14 prevents platform 12 from drifting and pitching due to the forces of wind, tide, current, and inclement weather.

Figure 2:
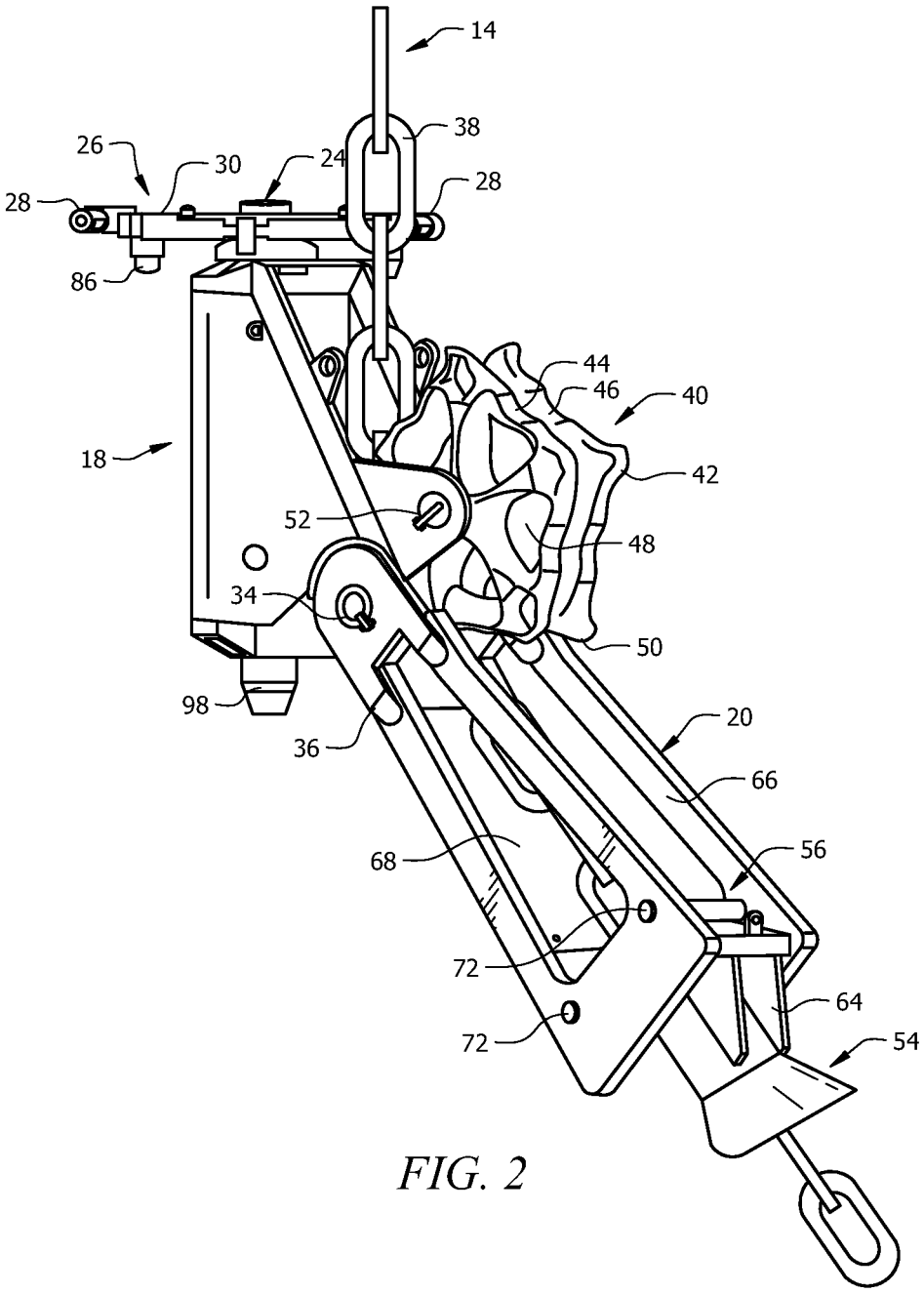
FIG. 2 is a perspective view of a first embodiment of the fairlead latch mechanism according to the aspects of the present disclosure.
Figure 3:
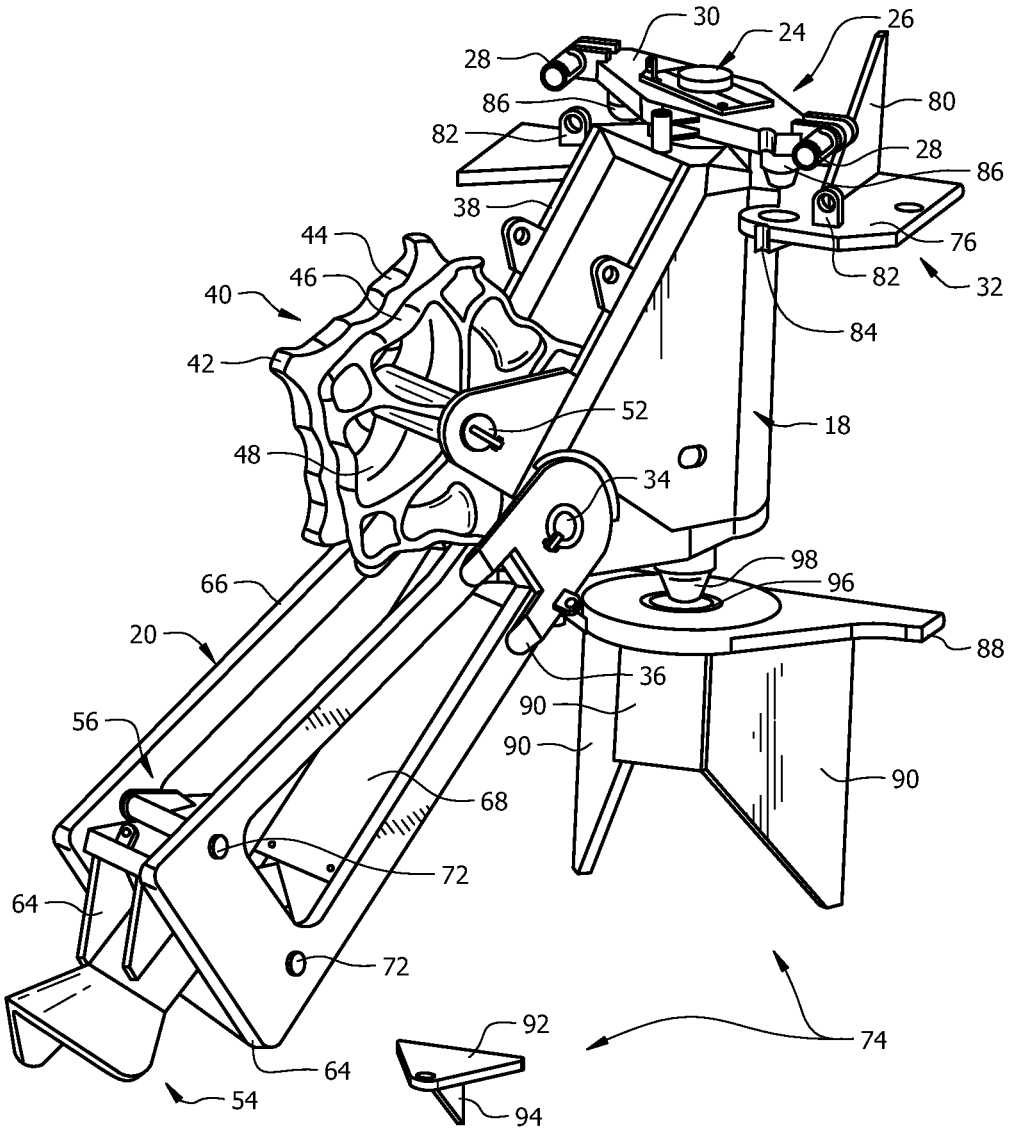
FIG. 3 is a perspective view of the embodiment of FIG. 2 with an exemplary configuration of an upper support structure and lower support structure according to the aspects of the present disclosure.
Figure 4:
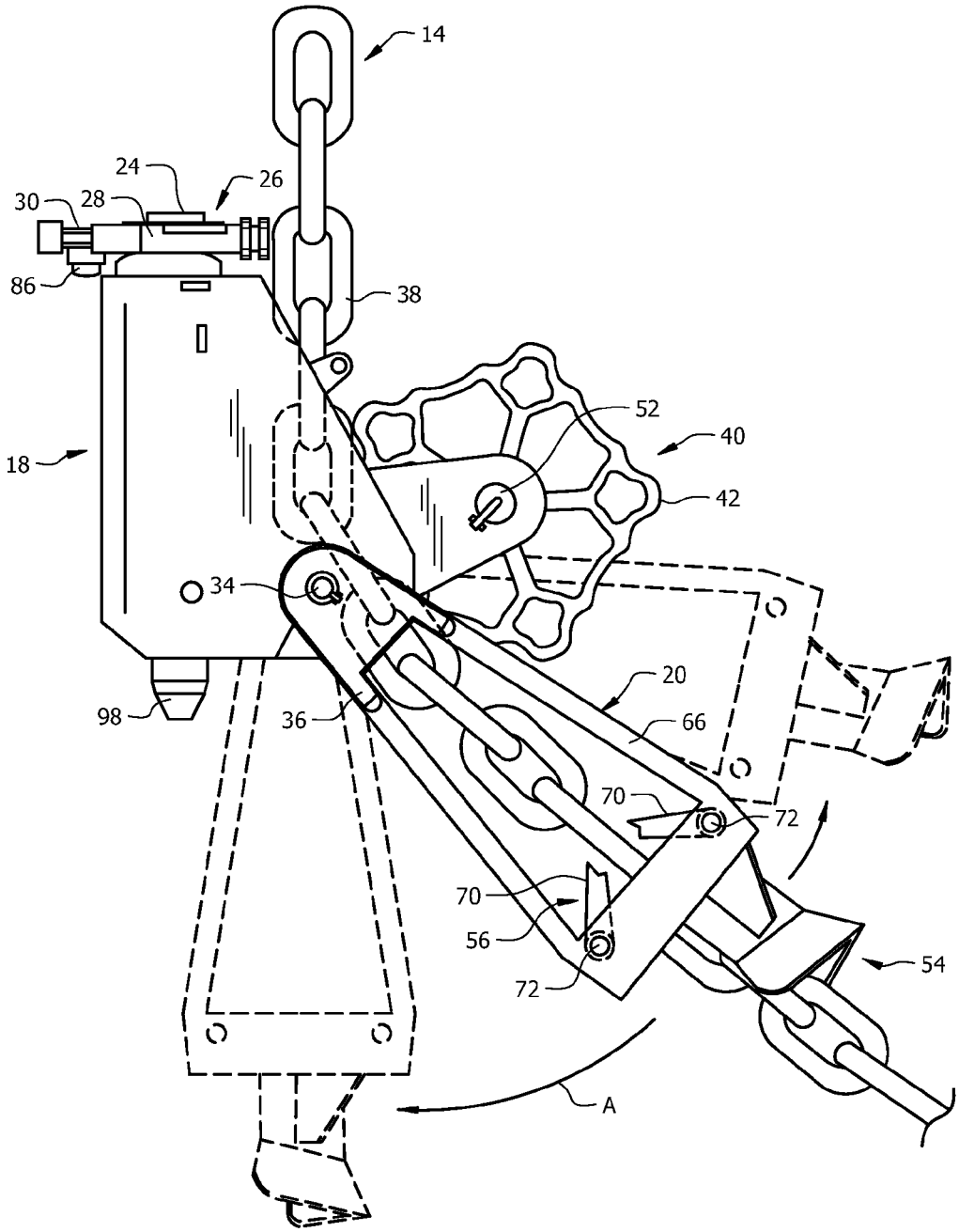
FIG. 4 is a side view of the fairlead latch mechanism of FIG. 2.
Figure 8:
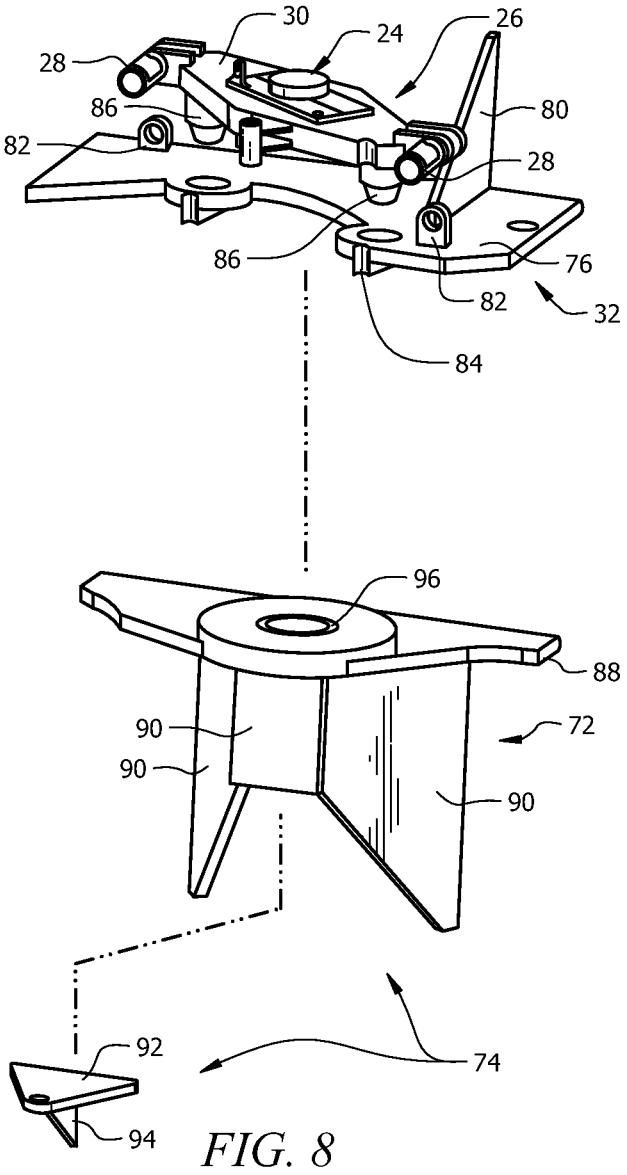
FIG. 8 is a perspective view of an exemplary configuration of an upper retainer component, upper support structure, and lower support structure according to the aspects of the present disclosure.

Referring to FIG. 1, each of the anchor chains 14 extends through fairlead latch mechanism 10 which operates to guide the anchor chain 14 during installation and maintain the proper tension on the installed anchor chains 14 to stabilize the platform 12. As shown in FIGS. 2-4, the fairlead latch mechanism 10 includes fairlead housing 18 and latch housing 20. In the preferred embodiment, fairlead housing 18 is pivotally mounted to a wall of an offshore structure, e.g., platform column 22 of platform 12 (in FIG. 1), through pivot joint 24. Pivot joint 24 preferably comprises an upper retainer 26 having pin components 28 attached to a horizontal retaining member 30, which allows attachment of fairlead housing 18 to platform column 22 or any other surface of the offshore structure, preferably through coupling of upper retainer 26 with upper support structure 32, as shown in FIGS. 3 and 8. In one embodiment, upper retainer 26 comprises a trunnion housing and thrust bearings (not shown) to achieve the pivot configuration, i.e., pivot joint 24. In other embodiments, other bearings or components that allow fairlead housing 18 to be pivotally mounted to the offshore structure can be used. Preferably, low friction bearings are used to provide low resistance to relative movements of the attached offshore structure. The pivot configuration allows fairlead housing 18 to rotate about pivot joint 24 to reduce stresses between fairlead housing 18 and the offshore structure, e.g. platform 12.

Referring to FIGS. 2-4, latch housing 20 is preferably pivotally connected to the fairlead housing 18. In one embodiment, the pivotal connection is a clevis type pivot connection that includes a pair of pivot pins 34 and a pair of thrust bearings (not shown) mounted on fairlead housing 18 in a pair of bearing brackets 36. The pivot connection between fairlead housing 18 and latch housing 20 allows latch housing 20 to pivot relative to fairlead housing 18, as shown by the broken lines in FIG. 4, in the direction of arrow A. Pivot pin 34 is preferably oriented perpendicularly to the pivot joint 24 to form a gimbled joint that provides relative movement in two planes perpendicular to each other (e.g., pivot joint 24 is vertical and pivot pin 34 is horizontal) to substantially reduce stresses imposed upon anchor chain 14 and upon the offshore structure, e.g., platform 12, or other surfaces to which fairlead latch mechanism 10 is attached. The gimbaled joint extends the life of the chain by minimizing inter-link chain wear and both in-plane and out-of-plane bending stress in anchor chain 14.

Anchor chain 14 is preferably oriented as shown in FIGS. 2 and 4 with the links 38 alternatively perpendicular to one another. In the preferred embodiment, fairlead housing 18 guides anchor chain 14 through a chain wheel (e.g., pocketed wheels or wildcats), a smooth wheel, a bending shoe, or other suitable means that facilitates the deployment or retrieval of anchor chain 14. In one embodiment, referring to FIGS. 2-4, chain wheel 40 is used to guide anchor chain 14. Chain wheel 40 also preferably maintains the alternatively perpendicular orientation of anchor chain 14. Chain wheel 40 maintains this orientation by engaging the tips of its teeth 42 with every other link 38 that faces chain wheel 40. In one embodiment, chain wheel 40 comprises a first side 44 and a second side 46. In the preferred embodiment, chain wheel 40 has five pockets 48. However, it is envisioned that the number of pockets for chain wheel 40 can vary depending on the desired application. As mentioned above, other means of maintaining the orientation and/or guiding chain 14 includes a smooth wheel or a bending shoe, as further discussed in FIGS. 9-13. Referring to FIGS. 2-3, the tips of teeth 42 of chain wheel 40 for first side 44 and second side 46 flare or extend outward in opposite directions, providing link engagement surface 50 for each teeth 42. The engagement surface 50 preferably engages the body of links 38 rather than going through the openings of links 38. Accordingly, chain wheel 40 can be used with studless chain without imposing excess stress on the chain links themselves.

Referring to FIGS. 2-4, chain wheel 40 is attached to fairlead housing 18 through joint 52, which allows chain wheel 40 to rotate and engage links 38 to maintain the alternating perpendicular orientation as anchor chain 14 is deployed or retrieved, thereby minimizing inter-link chain wear and both in-plane and out-of-plane bending on the anchor chain 14.

Figure 7:
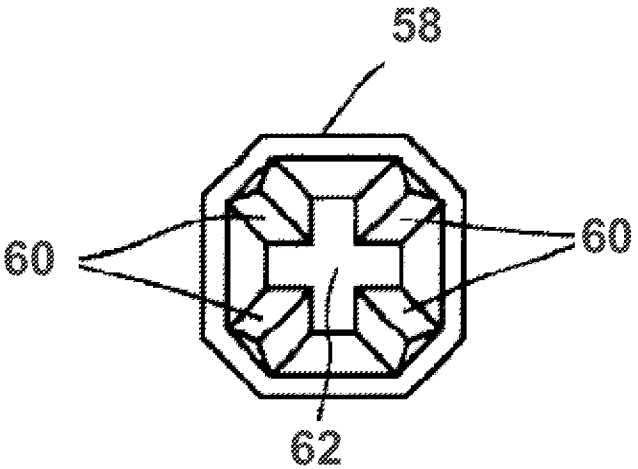
FIG. 7 is a front view facing an exemplary guide cone of the fairlead latch mechanism of FIG. 6.
Figure 6:
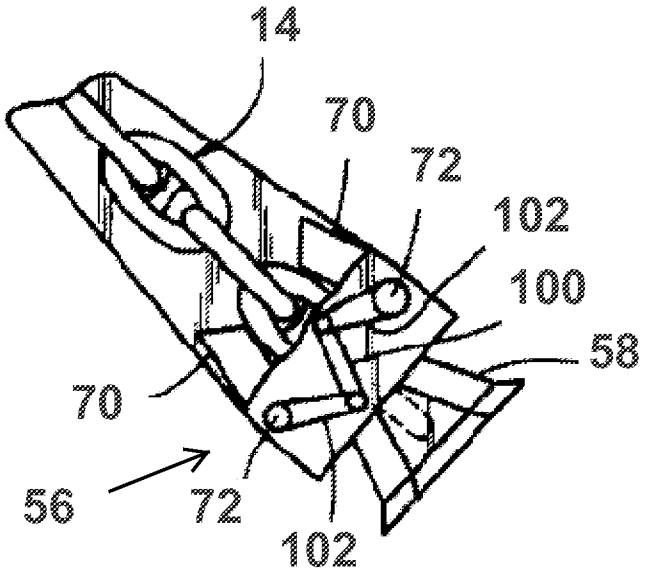
FIG. 6 is a partial side view of an exemplary latch housing of the fairlead latch mechanism according to the aspects of the present disclosure.

Guide member 54 of latch housing 20 is preferably mounted on the end of latch housing 20 away from fairlead housing 18. In the preferred embodiment, guide member 54 helps to ensure that anchor chain 14 enters latch housing 20 at the appropriate or desired angle and engages with chain wheel 40 at the proper or desired angle. Without guide member 54, anchor chain 14 likely rubs against various surfaces of latch mechanism 56 during deployment or retrieval of anchor chain 14. Guide member 54 can also help maintain the alternatively perpendicular orientation of the anchor chain 14 as described above. Referring to FIGS. 6 and 7, in one embodiment, the guide member comprises guide cone 58 and guide plate 60 providing an opening 62 in the general shape of a cruciform or plus sign that allows chain links of anchor chain 14 to pass through in their alternating perpendicular orientation. Referring to FIGS. 2-4, in another embodiment, guide member 54 does not provide an opening, but rather has a triangular shape that covers the top portion of chain links 38 to help guide links 38 in the desired direction into or out of latch housing 20. In another embodiment, guide member 54 further comprises a diamond shape without the cruciform. Referring to FIGS. 2-4, guide member 54 further comprises brackets 64 to provide support to and maintain guide member 54 at a desired position with respect to latch housing 20.

Figure 9:
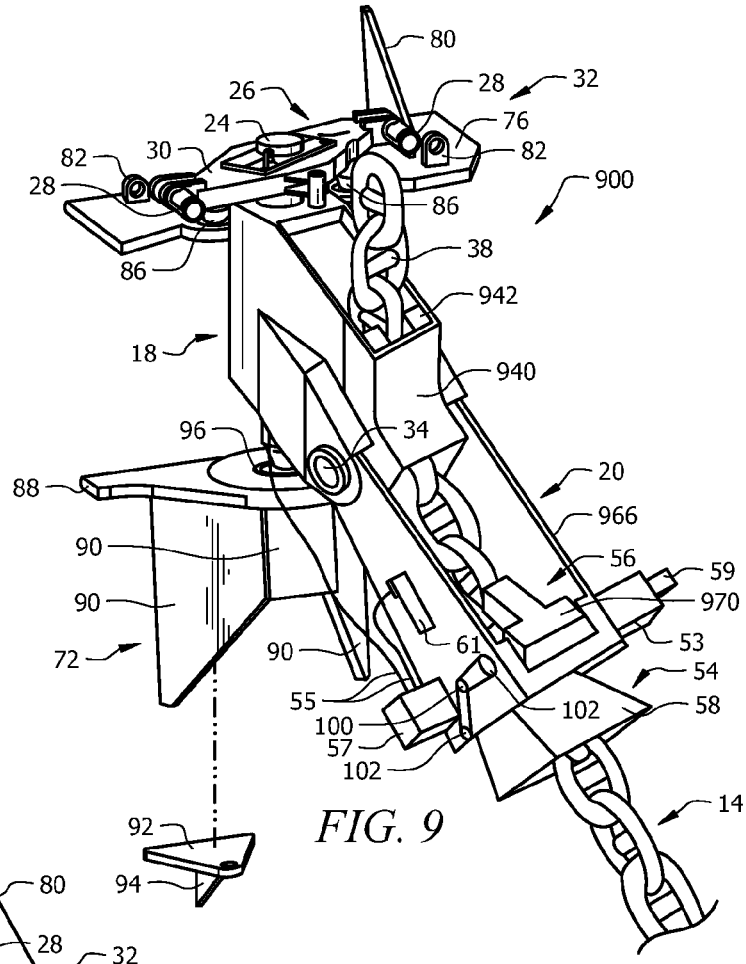
FIG. 9 is a perspective view of a second embodiment of the fairlead latch mechanism with an exemplary configuration of an upper support structure and lower support structure according to the aspects of the present disclosure.
Figure 10:
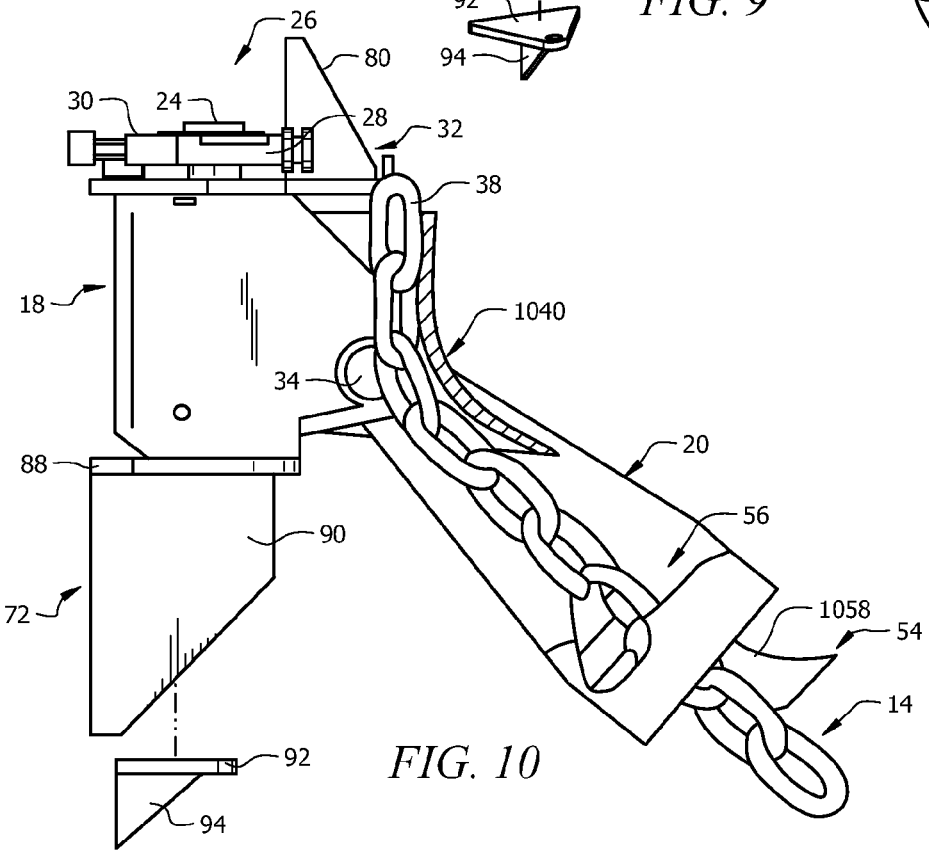
FIG. 10 is a side view of a third embodiment of the fairlead latch mechanism with an exemplary configuration of an upper support structure and lower support structure according to the aspects of the present disclosure.
Figure 11:
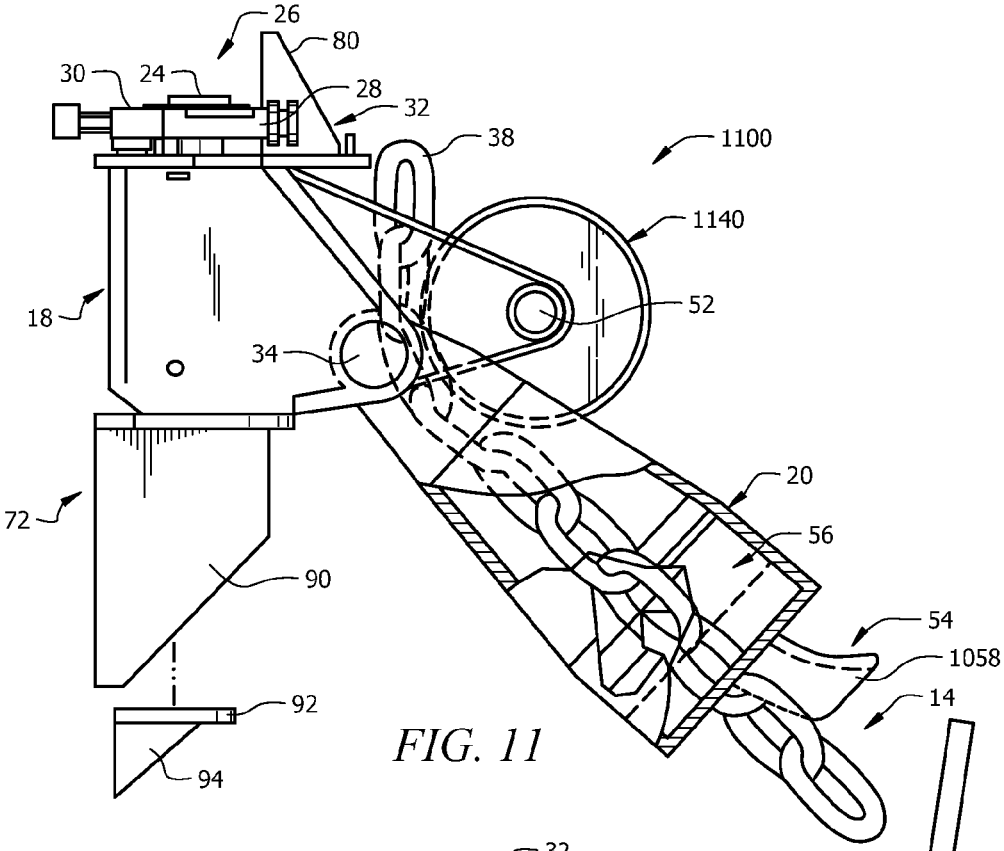
FIG. 11 is a side view of a third embodiment of the fairlead latch mechanism with an exemplary configuration of an upper support structure and lower support structure according to the aspects of the present disclosure.
Figure 14:
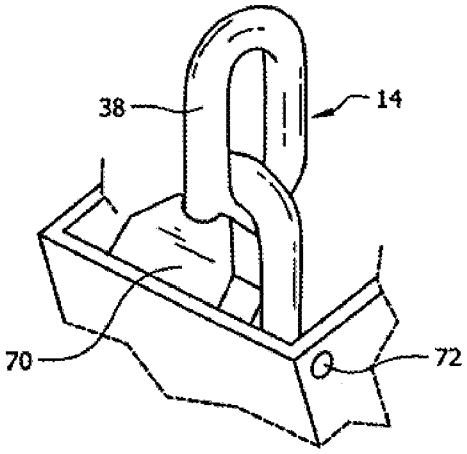
FIG. 14 is a perspective view of an exemplary latch mechanism according to the aspects of the present disclosure.

In the preferred embodiment, fairlead housing 18 comprises frame 66 which provide a pathway for anchor chain 14 to engage chain wheel 40 when anchor chain 14 is retrieved or deployed. Referring to FIGS. 2-3, frame 66 preferably comprises plate 68 attached to the bottom side. Alternatively, in other embodiments, latch housing 14 can comprise sidewalls instead of frame 66, which is depicted in FIGS. 9-11. The sidewalls may be desirable or appropriate for certain applications. Fairlead latch mechanism 10 further comprises latch mechanism 56 for locking anchor chain 14 in place when it is properly tensioned. Referring to FIGS. 4, 6, and 14, latch mechanism 56 includes a pair of latches 70, which are attached to latch housing 20 via shaft 72, which preferably extends through latches 70. The configuration preferably allows the rotation of shaft 72 to also rotate latches 70 between open and close positions. Referring to FIGS. 6 and 14, in a close position, latches 70 engages link 38 of anchor chain 14 and locks chain 14 in place. In an open position, latches 70 are rotated to a position that disengages with links 38. Preferably, when shaft 72 rotates, latches 70 also rotate correspondingly in response to engage links 38 to lock anchor chain 14 in position or disengage links 38 to allow anchor chain 14 to be further deployed or retrieved.

Shaft 72 can either be rotated manually or through a remotely operable system controlled from the surface. In one embodiment, the remotely operable system utilizes a hydraulic cylinder (not shown) mounted on latch mechanism 56, which can activated through hydraulic lines (not shown) that extend to the surface of the platform.

In embodiments using the hydraulic cylinder, it is connected to shaft 72 and rotates shaft 72 to open and close latches 70. Latches 70 can be configured to move synchronously with one another as one shaft 72 is rotated by associating the movement of one latch 70 with another. Referring to FIG. 6, in one embodiment, this is achieved through links 100 and 102. In particular, latch links 102 are connected to one another through latch link 100. In another embodiment, during the pull-in phase of anchor chain 14, latches 70 are hydraulically biased to such a position so as to act as a ratcheting pawl as anchor chain 14 passes through latch mechanism 56. To release anchor chain 14 from the ratcheting latches 70, the hydraulic cylinder rotates latch mechanism 56 to the open position. In another embodiment, latches 70 can be operated manually using a wire rope (not shown) attached to latch shaft 72 or links 100 and 02 of FIG. 6, which preferably terminates at the deck of the associated vessel, e.g., platform 12. Alternatively, latches 70 can be operated manually using a diver or an unmanned, remotely controlled submersible vehicle, e.g. Remote Operated Vehicle, using a suitable lever attached to latch shaft 72 or links 100 and 102.

In another embodiment, an extensiometer (not shown) can be mounted on latch housing 20 to measure the chain force in anchor chain 14 when it is held by latch mechanism 56. The extensiometer provides the chain hauling equipment operator with chain load information through electric cables. This information can also be sent wirelessly. In another embodiment, a latch position indicator (not shown) can be attached to shaft 72 or latch 56 to provide the operator with the position of latches 70 with respect to anchor chain 14. The latch position is communicated to the operator through electric cables which extend to the surface. This information can also be sent wirelessly. The latch position indicator can be mounted anywhere adjacent to shaft 72, but it is preferably located on the end of latch shaft 72.

Referring to FIGS. 3 and 8, fairlead latch mechanism 10 can be attached to a surface of an off-shore structure, such as that of platform column 22, using upper support structure 32 and lower support 74. In the preferred embodiment, upper support structure 32 and lower support structure 74 are attached to a wall or surface at a desired location for the fairlead latch device 10. Upper support structure 32 and lower support structure 74 are preferably attached to the wall by means known to those skilled in the art, such as welding. Upper support structure 32 comprises support plate 76. In the preferred embodiment, plate 76 comprises at least one column bracket 80 where horizontal edge of column bracket 80 is attached to the surface of plate 76 while the vertical edge of column bracket 80 is attached to the wall of the platform column 22 or any other attachment surface. Plate 76 also comprises upper retainer coupling components 82 attached to its surface that allow pin components 28 of upper retainer component 26 to attach to plate 76, and thus to upper support structure 32 and the offshore structure. Upper retainer coupling components 82 are preferably vertical openings to receive and retain pin components 28, which are preferably horizontal. As such, the insertion of pin components 28 through the openings of upper retainer coupling components 82 allows upper retainer component 26, and thus fairlead latch device 10, to be mounted to upper support structure 32, which is attached to the offshore vessel.

Plate 76 further comprises at least one opening 84, preferably two, to receive upper support structure engagement members 86 of upper retainer component 26. The complementary configuration of openings 84 and engagement members 86 allow for support and mounting of fairlead latch device 10 to upper support structure 32. In the preferred embodiment, upper retainer component 26 allows fairlead latch device 10 to be lifted straight up to the surface after upper retainer component 26 is disengaged with upper support structure 32, preferably by removing pin components 28 from the openings of upper retainer coupling components 82.

As additional support, fairlead latch mechanism 10 can further comprise lower support structure 74, which includes a horizontal plate 88 sitting on top of column brackets 90 that form three sides of lower support structure 74. Lower support structure 74 can also comprise a second horizontal plate 92 with corresponding column bracket 94 that forms the bottom of lower support structure 74.

Figure 5:
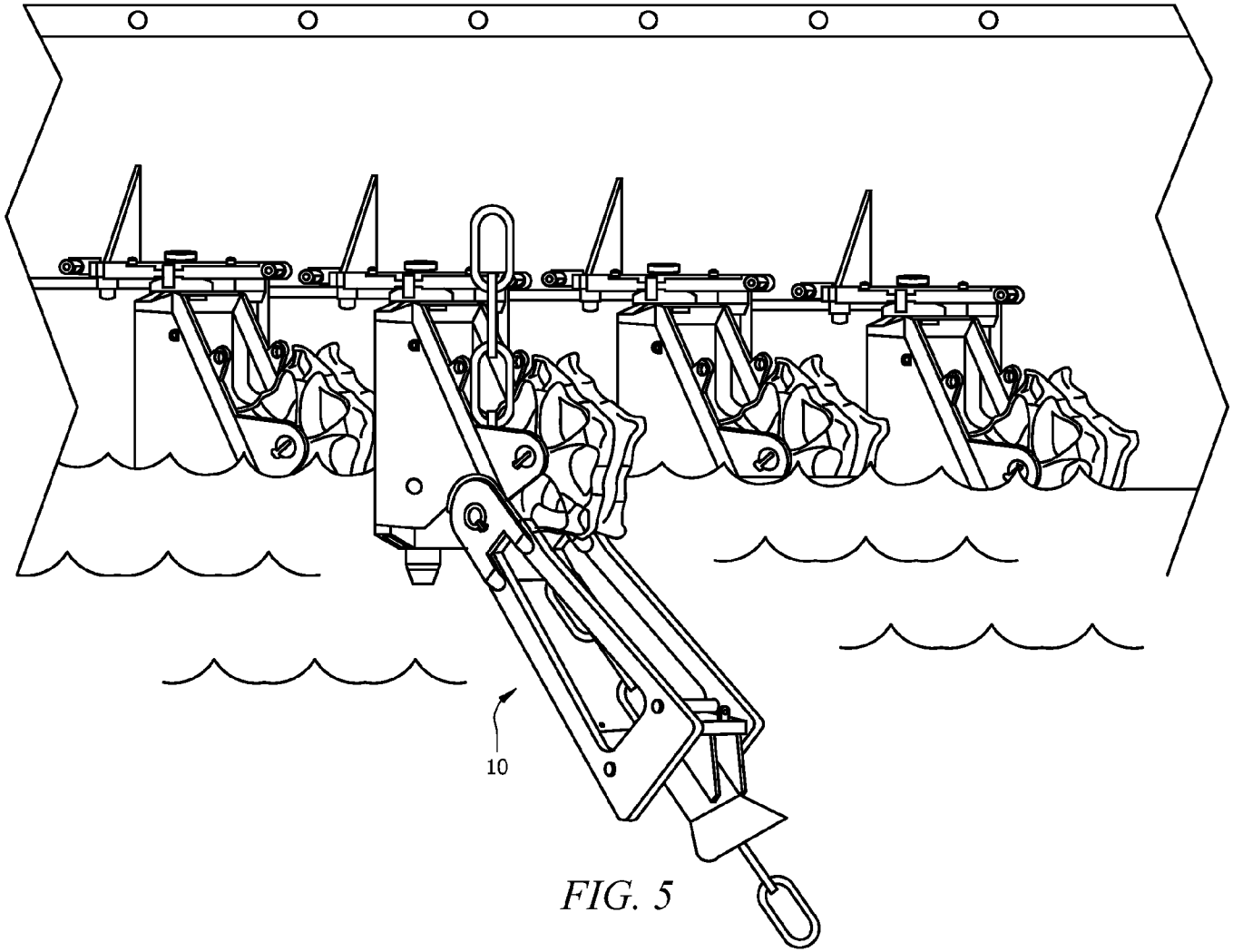
FIG. 5 is a perspective view of a series of fairlead latch mechanisms of FIG. 2.

Referring to FIG. 3, horizontal plate 88 comprises opening 96 to receive lower support structure engagement member 98 of fairlead housing 18, which is preferably the lower portion of pivot joint 24. In the installed configuration, lower support structure 74 provides additional support to fairlead housing 18, which rests on lower support structure 74 via the coupling between engagement member 98 and opening 96 of lower support structure 74. When desired or required, fairlead latch mechanism 10 can be separated from one upper support structure 32 at one location and attached to another upper support structure 32 at another location. Referring to FIG. 5, a series of fairlead device 10 can be installed adjacent to one another to provide the required mooring needs.

Upper retainer component 26, upper support structure 32, and lower support structure 74 can be employed with other fairlead latch device embodiments to facilitate separation and/or relocation of the fairlead latch device from the offshore structure. For instance, referring to FIG. 9, fairlead latch device 900 that is similarly configured as fairlead latch device 10 described with respect to FIGS. 2-4. Similar or like parts are generally indicated by identical reference numerals. Instead of chain wheel 40 as the guide structure, however, device 900 comprises bending shoe 940 mounted on the fairlead housing 918 that preferably maintains links 938 in alternatively perpendicular, as discussed above. This orientation is preferably maintained through a pair of chain guides 942 mounted on bending shoe 940 for engaging every other link 938 that is oriented perpendicular to the guide surface of bending shoe 940. Also, instead of frame 38, fairlead latch device 900 can comprise walls 966. As shown in FIG. 9, guide member 54 comprises guide cone 58 and guide plate 60 providing an opening 62 in the general shape of a cruciform or plus sign that allows chain links of anchor chain 14 to pass through in their alternating perpendicular orientation, as described in FIGS. 6-7. Also, as depicted in FIG. 9, latches 970 can comprise a generally T-shape configuration, where the bottom of the "T" engages links 38 to lock anchor chain 14, as an alternative embodiment to the shape of latches 70 depicted in FIG. 14.

As with fairlead latch device 10, links 38 can either be rotated manually or through a remotely operable system controlled from the surface. Referring to FIG. 9, in one embodiment, the remotely operable system utilizes hydraulic cylinder 53 mounted on latch mechanism 56, which is activated through hydraulic lines (not shown) that extend to the surface of the platform. This latch mechanism can be used for either the perpendicular/parallel chain orientation of the guided bending shoe or the natural chain orientation of the smooth bending shoe. If the smooth bending shoe is used, latch mechanism 56 can be rotated to a suitable angle for latches 70 or 970 to engage anchor chain 14 as described below.

Referring to FIG. 9, hydraulic cylinder 53 is connected to shaft 72 and rotates the shaft to open and close latches 970. Latches 970 synchronously move because latch links 102 are connected to one another through latch link 100. During the pull-in phase of anchor chain 14, latches 970 are hydraulically biased to such a position so as to act as a ratcheting pawl as anchor chain 14 passes through latch mechanism 56. To release anchor chain 14 from the ratcheting latches 970, hydraulic cylinder 53 rotates the latch mechanism to the open position.

Referring to FIG. 9, in one embodiment, extensiometer 61 is mounted on latch housing 20 to measure the chain force in anchor chain 14 when it is held by latch mechanism 56. Extensiometer 61 provides the chain hauling equipment operator with chain load information through electric cables 55. In another embodiment, latch position indicator 57 is attached to the shaft 72 to provide the operator with the position of latches 970 with respect to anchor chain 14. In one embodiment, the latch position is communicated to the operator through electric cables 57 which extend to the surface.

As described above, fairlead latch device 900 preferably further comprises upper retainer 26, upper support structure 32, and lower support structure 72, as described above with respect to FIGS. 4 and 8 to allow separation and/or relocation of fairlead latch device 900.

Referring to FIG. 10, in another embodiment, device 1000 is similarly configured as fairlead latch device 10 described with respect to FIGS. 2-4. Similar or like parts are generally indicated by identical reference numerals. Instead of chain wheel 40, device 1000 comprises bending shoe 940 mounted on fairlead housing 18. Unlike fairlead latch device 900, however, fairlead latch device 1000 does not include any chain guides, thus allowing anchor chain 14 to be oriented in its natural position. This configuration is preferred in applications that employ studless chain so the chain, when it assumes its natural position, does not suffer excess stress due to the lack of a stud. As shown in FIG. 10, guide member 54 comprises lead shoe 1058 coupled to latch housing 20 that guides anchor chain 14 into latch housing 20. lead shoe 1058 provides support for the outboard end of latch housing 20 and thereby ensures that latch housing 20 and latch mechanism 56 are located properly with respect to anchor chain 14.

As described above, fairlead latch device 1000 preferably further comprises upper retainer 26, upper support structure 32, and lower support structure 72, as described above with respect to FIGS. 4 and 8 to allow separation and/or relocation of fairlead latch device 1000.

Referring to FIG. 11, in another embodiment, device 1100 is similarly configured as fairlead latch device 10 described with respect to FIGS. 2-4, and devices 900 and 1000 described in FIGS. 9 and 10, respectively. Similar or like parts are generally indicated by identical reference numerals. Instead of a chain wheel or bending shoe, smooth wheel or sheave 1140 can be used to orient anchor chain 1014 in its natural position. As described above, fairlead latch device 1000 preferably further comprises upper retainer 26, upper support structure 32, and lower support structure 72, as described above with respect to FIGS. 4 and 8 to allow separation and/or relocation of fairlead latch device 1100.

Latch mechanisms 56 of fairlead latch devices 900, 1000, and 1100 can be operated manually or remotely as discussed above.

Figure 12:
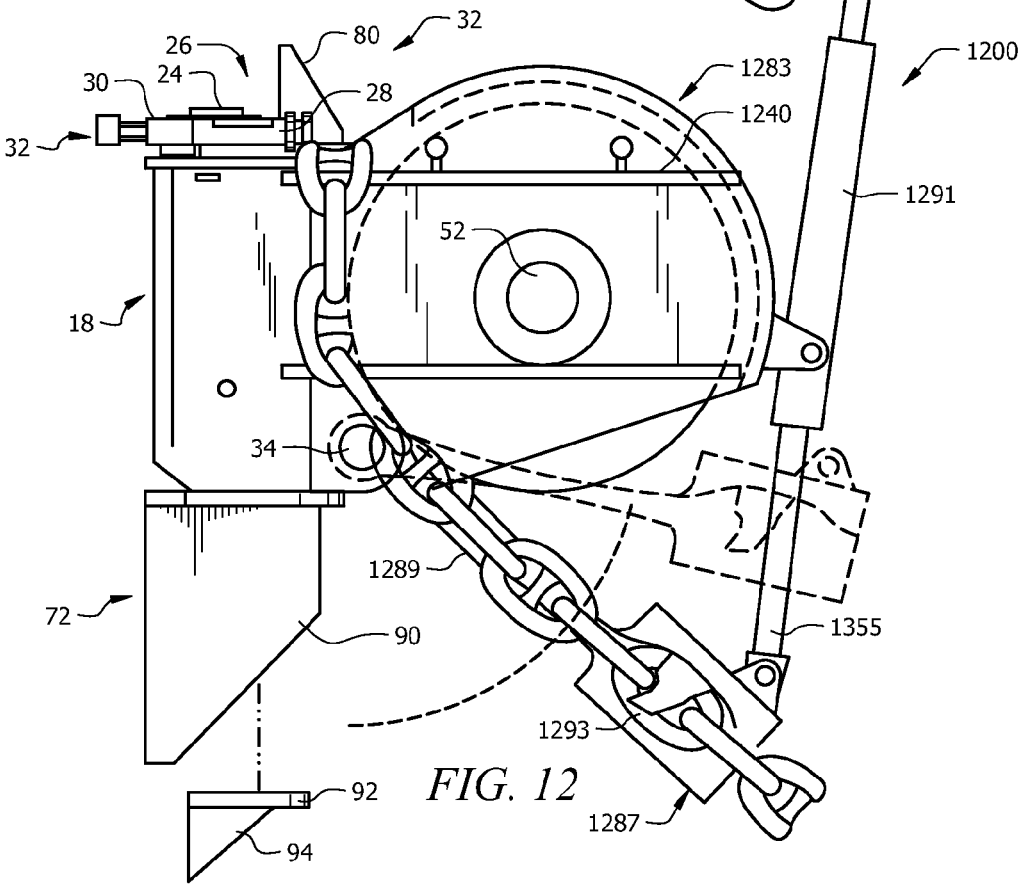
FIG. 12 is a side view of a fourth embodiment of the fairlead latch mechanism with an exemplary configuration of an upper support structure and lower support structure according to the aspects of the present disclosure.
Figure 13:
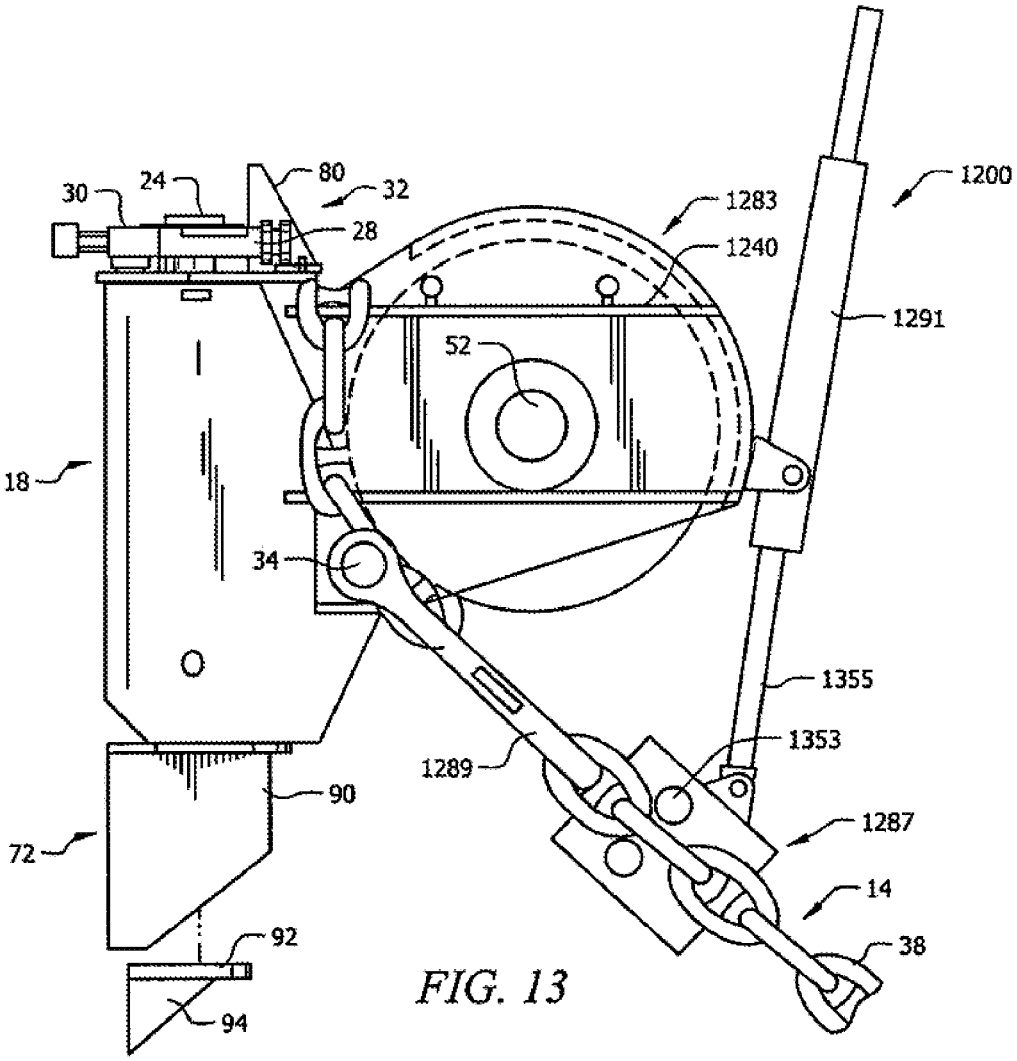
FIG. 13 is a side view of a fifth embodiment of the fairlead latch mechanism with an exemplary configuration of an upper support structure and lower support structure according to the aspects of the present disclosure.

Referring to FIGS. 12-13, there is fairlead latch device 1200. The latch housing and latches are replaced by pivoting pelican hook 1287 for locking anchor chain 14 in place when properly tensioned. Fairlead latch mechanism 1200 comprises fairlead housing 18 and latch assembly 1287. Fairlead housing 18 is pivotally mounted on an offshore structure, e.g., platform 12, as discussed above for fairlead latch device 10, i.e., through pivot joint 24. Fairlead housing 18 includes hood 1283, which is preferably mounted to upper retainer 26 in a way that does not obstruct the pivotal movement of fairlead housing 18 about pivot joint 24.

Latch assembly 1287 is preferably pivotally connected to fairlead housing 18 through a pivot connection that includes pivot pin 34 and a pair of thrust bearings (not shown) mounted on fairlead housing 1218 and a pair of bearing brackets 1236. Similar to the devices discussed above, the pivot connection between fairlead housing 18 and latch assembly 1287 allows latch assembly 1287 to pivot relative to fairlead housing 18, as shown by the broken lines in FIG. 12. Pivot pin 34 is preferably oriented perpendicular to pivot pin 24 to form a gimbled joint that provides relative movement in two planes perpendicular to each other to substantially reduce stresses imposed upon anchor chain 14 and upon the offshore structure.

As discussed above, anchor chain 14 can be oriented with links 38 preferably oriented alternatively perpendicular and parallel to a guide surface of rotatable sheave 1240 mounted on fairlead housing 18. This orientation can be maintained through a pair of chain guides mounted on the rotatable sheave 1240 for engaging every other link that is oriented perpendicular to the guide surface of the rotatable sheave 1240. As is commonly known in the art, the rotatable sheave 1240 may be a pocketed, a grooved, or a combination wildcat. As can be appreciated, rotatable sheave 1240 can be nonrotating or replaced with a bending shoe like those described above.

Referring to FIGS. 12-13, pelican hooks 1287 are preferably moved into and out of engagement with chain links 38 by arms 1289 (arm is behind chain 34 in FIG. 12) extending and retracting through hydraulic cylinder 1291 mounted on fairlead housing 18. Hydraulic cylinder 1291 is pivotally mounted to fairlead housing 18 and to channel 1293. After pelican hook 1287 engages chain link 14, hydraulic cylinder 1291 is preferably deactivated to permit free translation of arm 1289 within hydraulic cylinder 1291 resulting in the free rotation of latch assembly 1287 about pins 34. Although not shown, hydraulic cylinder 1291 is preferably activated through hydraulic lines that extend to the surface. Referring to FIG. 13, latch mechanism 1287 can include retractable pins 1353 which extend and retract from hydraulic actuator (not shown) to lock anchor chain 14 at the desired tension. Like hydraulic cylinder 1291, hydraulic actuator is preferably controlled from the surface through hydraulic lines (not shown). In one embodiment, during pull in and pay out of anchor chain 14, hydraulic cylinder 1291 can retract arm 1355 and latch assembly 1287, as depicted by the dotted lines in FIG. 12.

As described above, fairlead latch device 1200 preferably further comprises upper retainer 26, upper support structure 32, and lower support structure 72, as described above with respect to FIGS. 4 and 8 to allow separation and/or relocation of fairlead latch device 1200.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A fairlead latch device for guiding and securing an anchor chain, the fairlead latch device comprising:

an upper retainer component removably coupled to an offshore vessel;

a fairlead housing pivotally coupled to said upper retainer component and configured to receive and guide an anchor chain, wherein said upper retainer component is removablely coupled to an upper support structure, upper retainer component includes horizontal pin components and upper support component includes vertical coupling components, wherein the horizontal pin components engage the vertical coupling components allowing the fairlead mechanism to be attached to and to be disengaged from the upper support structure by removing the horizontal pin components from upper retainer coupling components;

a latch housing pivotally mounted to said fairlead housing;

a latch assembly mounted to said latch housing; and an actuator for operating said latch assembly.

2. The fairlead latch device of claim 1, wherein said upper retainer component includes at least two engagement members configured to be removably mated with the upper support structure attached to the offshore vessel.

3. The fairlead latch device of claim 2, wherein said at least two engagement members are disposed downwardly from said upper retainer component and engage openings in the upper support component.

4. The fairlead latch device of claim 1, further comprising a lower support structure.

5. A fairlead latch mechanism for guiding and securing an anchor chain, the fairlead latch mechanism comprising:

a fairlead housing pivotally coupled to an offshore structure, wherein said fairlead housing comprises an upper retainer component removablely coupled to an upper support structure attached to said offshore vessel, said upper retainer component includes horizontal pin components and said upper support component includes vertical coupling components, wherein the horizontal pin components engage the vertical coupling components allowing the fairlead mechanism to be attached to and to be disengaged from the upper support structure by removing the horizontal pin components from upper retainer coupling components;

wherein said fairlead housing is configured to receive and guide an anchor chain during deployment or retrieval of said anchor chain between said vessel and an anchor;

a latch housing pivotally mounted to said fairlead housing, wherein said latch housing extends away from said fairlead housing;

a latch mechanism mounted to said latch housing, wherein said latch mechanism includes a ratchet assembly; and an actuator for operating said ratchet assembly.

6. The fairlead latch device of claim 5, wherein said upper retainer component includes at least two engagement members configured to be removably mated with upper support structure attached to the offshore vessel.

7. The fairlead latch device of claim 6, wherein said at least two engagement members are disposed downwardly from said upper retainer component and engage openings in the upper support component.

8. The fairlead latch device of claim 5, further comprising a lower support structure.

9. The fairlead latch device of claim 1, wherein the vertical coupling components are on a top surface of the upper support component.

10. The fairlead latch device according to claim 1 wherein said fairlead housing is configured to guide an anchor chain using a guide structure selected from the group consisting of a chain wheel, a smooth wheel, and a bending shoe.

11. The fairlead latch device according to claim 1, wherein said latch assembly comprises at least two latches rotatably mounted to said latch housing.

12. The fairlead latch device according to claim 11, wherein said latch assembly comprises an hydraulic actuator for operating said latches.

13. The fairlead latch device according to claim 11, wherein said latch assembly comprises a manual system for operating said latches.

14. The fairlead latch device according to claim 11, wherein the movement of said latches are linked.

15. The fairlead latch device according to claim 1, wherein said latch housing comprises an instrumentation system for measuring tension in the anchor chain.

16. The fairlead latch device according to claim 1, wherein said latch assembly comprises a latch position indicator sensor.

17. The fairlead latch device according to claim 1 further comprising a lower support structure coupled to said fairlead housing.

18. The fairlead latch device according to claim 1 wherein said upper retainer component allows said fairlead latch device to be lifted from said upper support structure.

19. The fairlead latch device of claim 4, wherein said lower support structure includes an opening to engage with a third engagement member on a lower portion of the fairlead housing.

20. The fairlead latch mechanism according to claim 5, wherein said fairlead housing is configured to guide an anchor chain using a guide structure selected from the group consisting of a chain wheel, a smooth wheel, and a bending shoe.

21. The fairlead latch mechanism according to claim 5, wherein said ratchet assembly comprises at least two latches rotatably mounted to said latch housing.

22. The fairlead latch mechanism according to claim 21, wherein said ratchet assembly comprises an hydraulic actuator for operating said latches.

23. The fairlead latch mechanism according to claim 21, wherein said ratchet assembly comprises a manual system for operating said latches.

24. The fairlead latch mechanism according to claim 21, wherein the movement of said latches are linked.

25. The fairlead latch mechanism according to claim 5, wherein said latch housing comprises an instrumentation system for measuring tension in the anchor chain.

26. The fairlead latch mechanism according to claim 5, wherein said latch mechanism comprises a latch position indicator sensor.

27. The fairlead latch device of claim 8, wherein said lower support structure includes an opening to engage with a third engagement member on a lower portion of the fairlead housing.

28. The fairlead latch device of claim 5, wherein the vertical coupling components are on a top surface of the upper support component.

* * * * *